United States Patent [19]

Ducros

[11] Patent Number: 4,534,377

[45] Date of Patent: Aug. 13, 1985

[54] DEVICE FOR DECANTING A LIQUID FROM A RECIPIENT

[75] Inventor: Guy Ducros, St. Germain-les-Corbeil, France

[73] Assignee: Technique et Esthetique pour l'Industrie et la Distribution, Brunoy, France

[21] Appl. No.: 543,162

[22] Filed: Oct. 18, 1983

[30] Foreign Application Priority Data

Nov. 5, 1982 [FR] France ..... 82 18603

[51] Int. Cl.[3] ..... B65D 47/00; B67D 5/34

[52] U.S. Cl. ..... 137/212; 222/400.7

[58] Field of Search ..... 137/212, 209; 222/400.7, 397

[56] References Cited

U.S. PATENT DOCUMENTS 575,932 1/1897 Nageldinger ..... 137/212 X
2,504,009 4/1950 De Phillips ..... 222/397 X
3,251,419 5/1966 Howard ..... 137/212 X

FOREIGN PATENT DOCUMENTS 317629 9/1902 France .
2188459 1/1974 France .
998004 7/1965 United Kingdom .

*Primary Examiner*—Alan Cohan
*Attorney, Agent, or Firm*—Sandler & Greenblum

[57] ABSTRACT

The invention relates to a device for decanting a liquid from a receptacle. A body has a skirt for assembly in the upper opening of a receptacle and a transverse partition which is traversed by a first elbow for decanting liquid and a second elbow for injecting gas under pressure, this partition also supporting a tubular section with lower orifice for containing a ball while a perforated cap has an inner extension which prevents escape of this ball performing the role of safety valve in the event of excess pressure in the receptacle.

6 Claims, 3 Drawing Figures

DEVICE FOR DECANTING A LIQUID FROM A RECIPIENT

TECHNICAL FIELD OF THE INVENTION

The present invention relates to a device for decanting a liquid from a receptacle under the effect of a gas under pressure introduced into the latter.

BACKGROUND OF THE INVENTION

It has been known for a long time that by exerting a pressure, by means of a gas, on the upper surface of a liquid contained in a closed receptacle, this liquid can be made to rise in a tube immersed in the receptacle. However, care must be taken to limit the pressure to a value lower than that which the receptacle can withstand. In addition, as the receptacle is frequently provided with an upper opening for filling purposes, this opening must be stopped, at least in that part of its section which is not occupied by the tube in which the liquid is made to rise and which is generally immersed in the recipient via this opening.

SUMMARY OF THE INVENTION

It is an object of the present invention to provide a compact, simple device which enables all these operations to be carried out with one manipulation and which, in addition, offers other useful functions for decanting a liquid rapidly and precisely.

A device according to the invention comprises a body having a transverse wall with a skirt adapted to be rapidly and hermetically mounted on the opening of a receptacle. This transverse wall is traversed by an elbow for decanting and by an elbow for injecting gas under pressure, each of these two elbows having an inner limb which extends from the transverse partition to inside the recipient and an outer limb which extends outside the body; in addition, a safety valve is supported by the transverse partition.

On the side opposite the skirt, the body is preferably provided with a perforated cap.

The elbow for injecting gas under pressure preferably comprises a valve placed at the joint of the two limbs with a mobile member accessible outside the body; this valve at least allows or prevents admission of the pressurized gas inside the receptacle.

In a preferred embodiment of the invention, the valve may be placed in three distinct positions, corresponding respectively to the admission of the pressurized gas in the receptacle, to the isolation of the recipient, and to aeration of the receptacle. The safety valve is constituted by a tubular section rising opposite the skirt from the transverse partition, opening towards the interior of the receptacle via an opening of determined size and containing a means for closing this opening under the effect of gravity. This closing means is preferably a ball.

According to a preferred embodiment of the invention, the cap possesses an inner extension which extends substantially as far as the top of the tubular section and which retains the ball.

The inner limb of the elbow for injecting gas is closed at its end directed towards the surface of the liquid and a gas evacuation orifice is provided in the lateral wall of this limb.

BRIEF DESCRIPTION OF THE DRAWINGS

The invention will be more readily understood on reading the following description with reference to the accompanying drawing, in which.

DETAILED DESCRIPTION AND PREFERRED EMODIMENT

Figure 1:
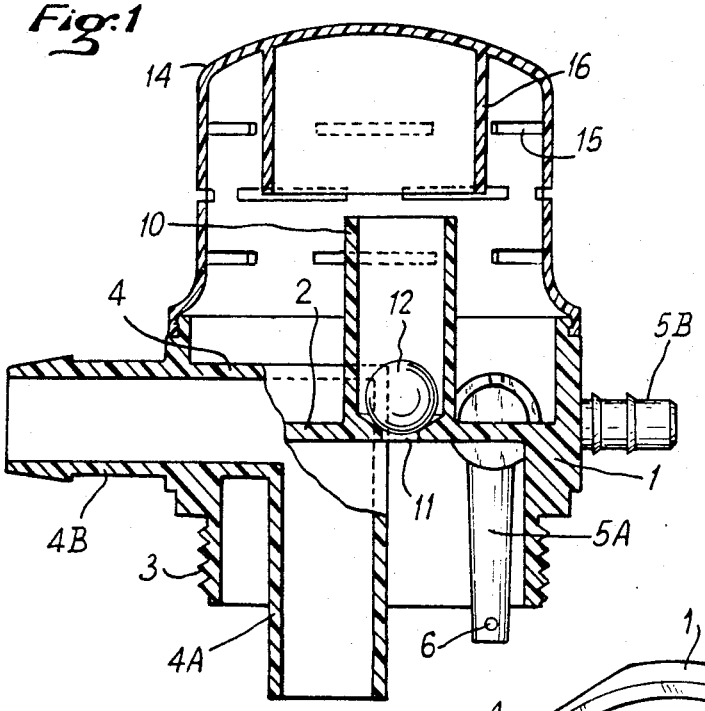
FIG. 1 is a view in section along I—I of FIG. 2 of a decanting device according to the invention.
Figure 2:
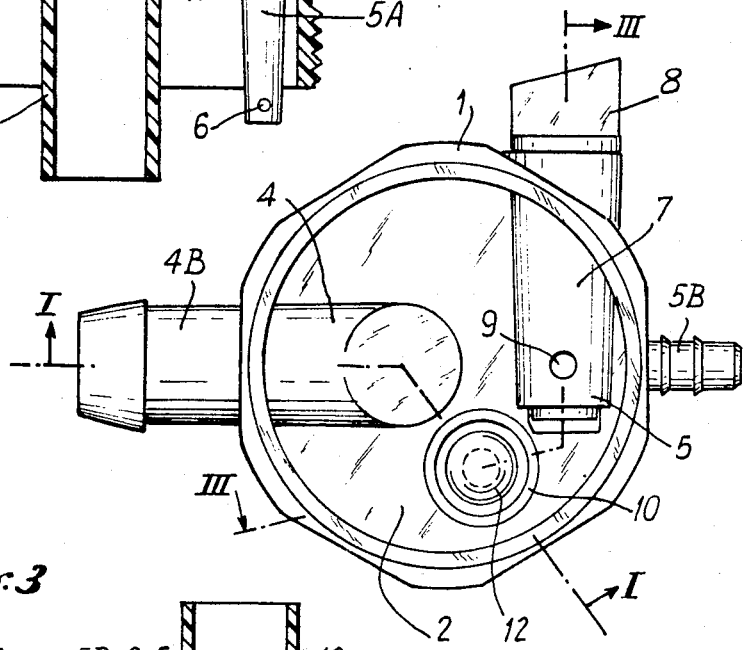
FIG. 2 is a plan view of the device of FIG. 1, the cap being assumed to have been removed.
Figure 3:
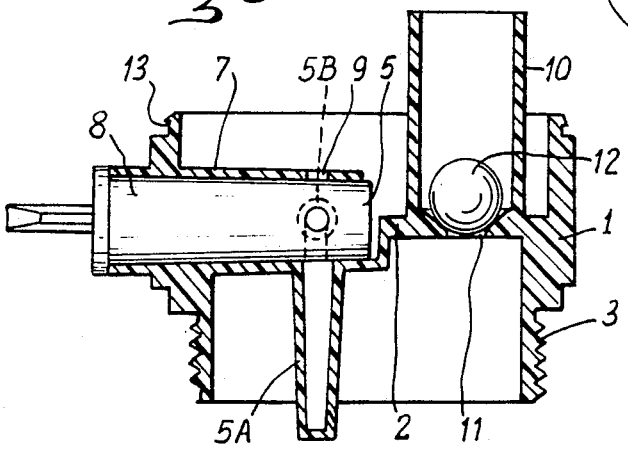
FIG. 3 is a view in section along III—III of FIG. 2.

Referring now to the drawings, the decanting device described here by way of example is particularly adapted to decanting more or less viscous liquid products delivered in conventional casks having on their upper wall a 2" bunghole closed by a metal stopper screwed therein.

The device of the invention has a body 1 with an inner transverse wall 2 on one side of which extends a skirt 3 adapted for rapid and hermetic assembly on a receptacle. In this case, the skirt 3 is threaded to screw in the bunghole of a cask in place of the stopper. The transverse wall 2 is traversed by a first elbow 4 for decanting and by a second elbow 5 for injecting gas under pressure. Each of these elbows 4, 5 has, an inner limb 4A, 5A, respectively which extends from the transverse partition 2 inside the skirt 3 towards the interior of the receptacle. Limb 4A of elbow 4 for decanting is open at its free end and it is adapted to be extended by a pipe descending to the bottom of the receptacle. Limb 5A of elbow 5 for injecting gas is closed at its free end but it presents an orifice 6 in its lateral wall.

Each of the two elbows 4, 5 has an outer limb 4B, and 5B which extend outside the body 1, above skirt 3. Limb 4B of elbow 4 for decanting is open at its free end and it is adapted to be extended by a pipe. Limb 5B of elbow 5 for injecting as is open at its free end and is adapted to be connected to a source of pressurized gas, for example a reservoir of compressed air.

It is advantageous to place a valve 7 at the joint of limbs 5A, 5B of elbow 5 for injecting gas. This valve 7 has a mobile member 8 accessible outside the body 1. This mobile member 8 may occupy three positions, viz. a first position in which it allows communication of limbs 5A and 5B, i.e. it allows pressurized gas to enter the receptacle, a second position in which limbs 5A and 5B are isolated from each other, i.e. the pressurized gas cannot enter the receptacle, a third position in which limb 5B is isolated from limb 5A and the latter is placed in communication with the atmosphere via an orifice 9 which opens opposite the inner limb 5A. In this position, the internal volume of the receptacle is placed in direct communication with atmosphere, which immediately eliminates any pressure inside this receptacle.

From the transverse partition 2 on the side opposite that of the skirt 3, a tubular section 10 extends, opening on the interior of skirt 3, i.e. towards the interior of the receptacle, via a calibrated orifice 11 which is normally closed by a ball 12. In the event of excessive pressure inside the receptacle, the ball 12 performs the role of a safety valve.

On the side opposite skirt 3, the body 1 presents a raised edge 13 adapted, preferably thanks to a circular groove, for the assembly of a cap 14 perforated by slots 15. An internal extension 16 extends from the top of the cap 14 to near the free end of the tubular section 10.

When the cap 14 is placed in position on the body 1, retained by the raised edge 13, the cylindrical inner extension 16 prevents the ball 12 from escaping when the device is turned over.

What is claimed is:

1. A decanting device including a body provided with a skirt for assembly on a receptacle, comprising:

a partition including an inner transverse wall, a first elbow-shaped conduit for decanting liquid from the receptacle and a second elbow-shaped conduit for injecting gas into the receptacle, said first conduit and said second conduit traversing said inner transverse wall, a cap connected to said body and having an inner extension, a safety valve associated with said inner transverse wall comprising a tubular member extending away from the side of said transverse wall opposite said skirt towards said inner extension of said cap.

2. The device of claim 1, wherein the body has a raised edge to which said cap is connected on its side opposite the skirt.

3. The device of claim 1 wherein said inner transverse wall has an orifice open to the atmosphere and said second elbow-shaped conduit for injecting gas has inner and outer limbs and is provided with a valve having a mobile member accessible from outside the body adapted to occupy three positions;

a first position for placing said limbs of said elbow in communication, a second position for isolating said limbs, and a third position for brining the inner limb into position for communication with said orifice.

4. A device for decanting a liquid from a receptacle having an upper wall with an opening, comprising:

a hollow body with a first end and a second end, said first end being provided with a means for fitting with said opening so that said body and said receptacle can be assembled together, and said second end being provided with means for fastening, a cap fastened to said means for fastening, a transverse wall separating said body into at least two parts in an intermediate zone between aid first end and said second end, a first elbow-shaped conduit for decanting having an outer limb supported by said transverse wall and extending outside said body, and an inner limb extending in the direction of said second end from said transverse wall, a second elbow-shaped conduit for the admission of air having an outer limb supported by said transverse wall and extending out from said body, and an inner limb extending in the direction of said second end from said transverse wall, and a valve supported by said transverse wall, said valve being placed transversely with respect to a said limb of the second elbow-shaped conduit, and having a mobile member accessible from outside said body adapted to occupy at least two functional positions.

5. The decanting device of claim 4 wherein said cap is perforated, said transverse wall has an orifice and said valve is provided with an opening capable of communicating with said orifice when said valve occupies one of said functional positions so that the receptacle may be vented through the cap to the atmosphere.

6. A device for decanting a liquid from a receptacle having an upper wall with an opening comprising:

a hollow body with a first end and a second end, said first end being provided with means for fitting with said opening so that said body and said receptacle can be assembled together, and said second end being provided with a means for fastening, a cap fastened to said means for fastening and having an inner extension, a transverse wall having an opening and separating said body into at least two parts in an intermediate zone between said first end and said second end, said transverse wall being provided at said first end with a tubular member surrounding said opening and containing a means capable of closing said opening, said tubular member extending towards said inner extension of said cap so that said means capable of closing is prevented from leaving said tubular member when said cap is fastened to said body, a first elbow-shaped conduit for decanting having an outer limb supported by said transverse wall and extending outside said body and an inner limb extending in the direction of said end from said transverse wall, a second elbow-shaped conduit for the admission of air having an outer limb supported by said transverse wall and extending out from said body, and an inner limb extending in the direction of said second end from said transverse wall, and a valve supported by said transverse wall, said valve being placed transversely with respect to a said limb of said second elbow-shaped conduit, and a mobile member accessible from outside the body adapted to occupy at least two functional positions.

* * * * *